US009796551B2

(12) United States Patent
Hoshi

(10) Patent No.: US 9,796,551 B2
(45) Date of Patent: Oct. 24, 2017

(54) PAPER GUIDE MECHANISM

(71) Applicant: SATO HOLDINGS KABUSHIKI KAISHA, Tokyo (JP)

(72) Inventor: Kazuyuki Hoshi, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/432,288

(22) PCT Filed: Jun. 12, 2013

(86) PCT No.: PCT/JP2013/066149
§ 371 (c)(1),
(2) Date: Mar. 30, 2015

(87) PCT Pub. No.: WO2014/109080
PCT Pub. Date: Jul. 17, 2014

(65) Prior Publication Data

US 2015/0259167 A1 Sep. 17, 2015

(30) Foreign Application Priority Data

Jan. 8, 2013 (JP) ..... 2013-000971

(51) Int. Cl.
*B65H 1/00* (2006.01)
*B65H 9/10* (2006.01)
(Continued)

(52) U.S. Cl.
CPC ..... *B65H 9/101* (2013.01); *B65H 1/04* (2013.01); *B65H 9/004* (2013.01); *B65H 9/04* (2013.01);
(Continued)

(58) Field of Classification Search
CPC ..... B65H 9/00; B65H 9/101; B65H 31/20; B65H 2405/10; B65H 2405/11;
(Continued)

(56) References Cited

U.S. PATENT DOCUMENTS 4,874,159 A * 10/1989 Maeno ..... B41J 13/103 271/126
6,116,591 A * 9/2000 Kim ..... B65H 1/04 271/126
(Continued)

FOREIGN PATENT DOCUMENTS

EP 2 487 125 A1 8/2012
JP 5-48463 6/1993
(Continued)

OTHER PUBLICATIONS

International Search Report dated Jul. 9, 2013 issued in corresponding International patent application No. PCT/JP2013/066149.
(Continued)

*Primary Examiner* — Prasad Gokhale
(74) *Attorney, Agent, or Firm* — Ostrolenk Faber LLP

(57) ABSTRACT

A paper guide mechanism that facilitates operation without easily allowing deviation of a wide guide unit. In a paper guide mechanism (10), a position-holding member (13) holds the widthwise position of a widthwise moving member (12) by bringing a first fixing-side locking section (11*e*) and a first moving-side locking section (13*d*) into contact with each other on a surface perpendicular to a direction of movement of the widthwise moving member (12) even in a case in which the widthwise moving member (12) is about to move in any direction along the width direction. The position-holding member (13) has a movement-restricting section (13*e*). The movement-restricting section (13*e*) restricts the movement of the position-holding member (13) in an orientation in which the first fixing-side locking section
(Continued)

(11*e*) and the first moving-side locking section (13*d*) are moved away from each other by bringing the position-holding member (13) into contact with a second surface of a supporting member (11) on a side opposite to a first surface.

5 Claims, 9 Drawing Sheets

(51) Int. Cl.
*B65H 31/20* (2006.01)
*B65H 1/04* (2006.01)
*B65H 9/00* (2006.01)
*B65H 9/04* (2006.01)

(52) U.S. Cl.
CPC ..... *B65H 31/20* (2013.01); *B65H 2404/742* (2013.01); *B65H 2405/114* (2013.01); *B65H 2405/121* (2013.01); *B65H 2511/12* (2013.01); *B65H 2511/22* (2013.01)

(58) Field of Classification Search
CPC ..... B65H 2405/114; B65H 2405/1144; B65H 2511/00; B65H 2511/10; B65H 2511/12
See application file for complete search history.

(56) References Cited

U.S. PATENT DOCUMENTS 6,267,522 B1 * 7/2001 Slippy ..... B65H 1/04 101/232
7,134,657 B2 * 11/2006 Yanagi ..... B65H 3/0661 271/171
8,052,141 B2 * 11/2011 Yamagishi ..... B65H 1/266 271/171
2002/0067944 A1 * 6/2002 Lee ..... B65H 1/04 400/624
2002/0167125 A1 * 11/2002 Nakamura ..... B65H 3/0661 271/171
2004/0036208 A1 * 2/2004 Yanagi ..... B65H 3/0661 271/171
2006/0091599 A1 * 5/2006 Okuda ..... B41J 11/0025 271/248
2006/0182450 A1 * 8/2006 Wada ..... B41J 13/103 399/8
2006/0237897 A1 * 10/2006 Terao ..... B65H 3/0661 271/145
2008/0048389 A1 * 2/2008 Shimazu ..... B41J 13/103 271/253
2008/0298873 A1 * 12/2008 Yamagishi ..... B65H 1/266 400/624
2009/0121412 A1 * 5/2009 Koyanagi ..... B65H 1/00 271/117
2009/0189341 A1 * 7/2009 Koyanagi ..... B65H 1/00 271/264
2009/0295068 A1 12/2009 Kubo ..... 271/18
2011/0037220 A1 * 2/2011 Nishinakama ..... B65H 1/02 271/233
2015/0203311 A1 * 7/2015 Matsumoto ..... B65H 1/266 271/241

FOREIGN PATENT DOCUMENTS

JP 7-285681 10/1995
JP 3069307 3/2000
JP 2001-302028 10/2001
JP 2003/341886 12/2003
JP 2005-161523 6/2005
JP 2007-197159 A 8/2007
JP 2008-12829 1/2008

OTHER PUBLICATIONS

Extended European Search Report issued Nov. 23, 2015 in corresponding Application No. 13871049.6.
Notification of Reasons for Refusal dated Apr. 4 2017 in corresponding Japanese Patent Application No. 2013-000971 (with machine translation)(total 6 pages).

* cited by examiner

PAPER GUIDE MECHANISM

CROSS REFERENCE TO RELATED APPLICATIONS

The present application is a 35 U.S.C. §371 National Phase conversion of PCT/JP2013/066149, filed Jun. 12, 2013, which claims benefit of Japanese Application No. 2013-000971, filed Jan. 8, 2013, the disclosure of which is incorporated herein by reference. The PCT International Application was published in the Japanese language.

TECHNICAL FIELD

The present invention relates to a paper guide mechanism that guides paper to be fed, for example, in a label printer, a tag printer, or the like.

BACKGROUND INFORMATION

A paper guide mechanism is applied to printing devices that feed paper for printing, such as label printers, tag printers, and the like. Various sizes of labels, tags, and the like are used depending on applications, and thus, a typical paper guide mechanism can vary a guide position that is movable in the width directions in accordance with the width of paper to be fed.

For example, Patent Literature 1 discloses a mechanism that locks a position of a paper guide member by engagement of engagement portions (protrusions and dents) with each other. This paper guide member serves to guide sheets of paper in the width directions.

CITATION LIST

Patent Literature

Patent Literature 1: Japanese Laid-Open Patent Publication No. H07-285681 A.

SUMMARY OF THE INVENTION

Problem(s) Solved by the Invention

However the protrusion of the paper guide member shown in Patent Literature 1 is a triangular shape in cross section. For this reason, interlocking force will be low when a force is applied toward the oblique side of the triangular shape. In other words, when an external force is applied to the paper guide member in a direction along which the force acts on the oblique side of the triangular shape, a component of the external force that moves the engagement portions away from each other will be provided. This may cause disengagement of the engagement portions, which lock the paper guide member, from each other. If the engagement portions are disengaged from each other, the paper guide member will be easily moved and fail to perform its paper guide function.

In order to reduce the possibility of the aforementioned disengagement of the engagement portions from each other, it is conceivable that the height of the engagement portion is increased. However, in this case, the pitch of the protrusions or dents of the engagement portion is increased. Accordingly, the distance of the discrete points for locking the position of the paper guide member in the width directions is also increased. Therefore, there is a problem that the positions of the paper guide member cannot be adjusted in fine increments.

Also, in order to reduce the possibility of the aforementioned disengagement of the engagement portions from each other, it is conceivable that the applied force of a biasing member is increased which applies force to the engagement portions toward each other so that they contact. However, in this case, an operating force is also increased which is required for operators to move the paper guide member, which results in bad operability.

It is an object of the present invention to provide a paper guide mechanism that includes a width guide less likely to be unintentionally moved, and that provides good operability.

Means for Solving the Problem(s)

The present invention solves the above-described problem with the following means.

One embodiment of the invention is a paper guide mechanism for guiding paper to be fed, the paper guide mechanism comprising: a width guide that guides the both sides of the paper in the width directions which intersect the feeding directions of the paper; at least one pair of engagement portions each including identically-shaped elements that are aligned in the width directions, the at least one pair of engagement portions being interlocked on the surfaces perpendicular to the width directions with each other, such that the movement of the width guide in the width directions is restricted; and a movement restrictor that restricts one engagement portion of the movement of the at least one pair of engagement portions.

Another aspect of the invention is the paper guide mechanism further comprising a supporting member, wherein the width guide includes: a width movement member that is movable in the width directions, the width movement member being attached to the supporting member, and a position-holding member that locks a position of the width movement member in the width directions, the position-holding member being attached to the width movement member, wherein the engagement portions includes: a fixing engagement portion that is arranged on the supporting member, the fixing engagement portion including the identically-shaped elements aligned in the width directions on a first surface of the supporting member, the first surface facing the surface of the paper in feeding, and a movement engagement portion that is arranged on the position-holding member and that faces the fixing engagement portion, the movement engagement portion including the identically-shaped elements aligned in the width directions, and wherein the movement restrictor is arranged on the position-holding member, and contacts a second surface of the supporting member, the second surface being opposite to the first surface.

Another aspect of the invention is the paper guide mechanism, wherein the engagement portions includes: a first fixing engagement portion that is arranged on the first surface; a first movement engagement portion that is arranged to be facing the first fixing engagement portion; a second fixing engagement portion that is arranged on the second surface; and a second movement engagement portion that is arranged to be facing the second fixing engagement portion, and wherein the identically-shaped elements are formed so that: when the width movement member is moved toward one direction of the width directions, the position of the width movement member in the width directions is locked by contact of the first fixing engagement portion and the first movement engagement portion at a surface perpendicular to the moving direction of the width movement member, and when the width movement member is moved toward the other direction of the width directions, the position of the width movement member in the width directions is locked by contact of the second fixing engagement portion and the second movement engagement portion at a surface perpendicular to the moving direction of the width movement member.

Another aspect of the invention is the paper guide mechanism, further comprising a biasing member, wherein the position-holding member is movable in a direction along the feeding directions between a locked position and an unlocked position, wherein the position of the width movement member in the width directions is locked when the position-holding member is located at the locked position, and the position of the width movement member in the width directions is unlocked when the position-holding member is located at the unlocked position, and wherein the biasing member applies force toward the locked position to the position-holding member.

Another aspect of the invention is the paper guide mechanism, wherein the position-holding member is detachably attached to the width movement member using a fastening member.

Effects of the Invention

According to the paper guide mechanism of the present invention, a width guide is less likely to be unintentionally moved, and provides good operability.

EMBODIMENT(S) FOR CARRYING OUT THE INVENTION

The following description will describe the best mode of carrying out the invention with reference to the drawings.

First Embodiment

Figure 1:
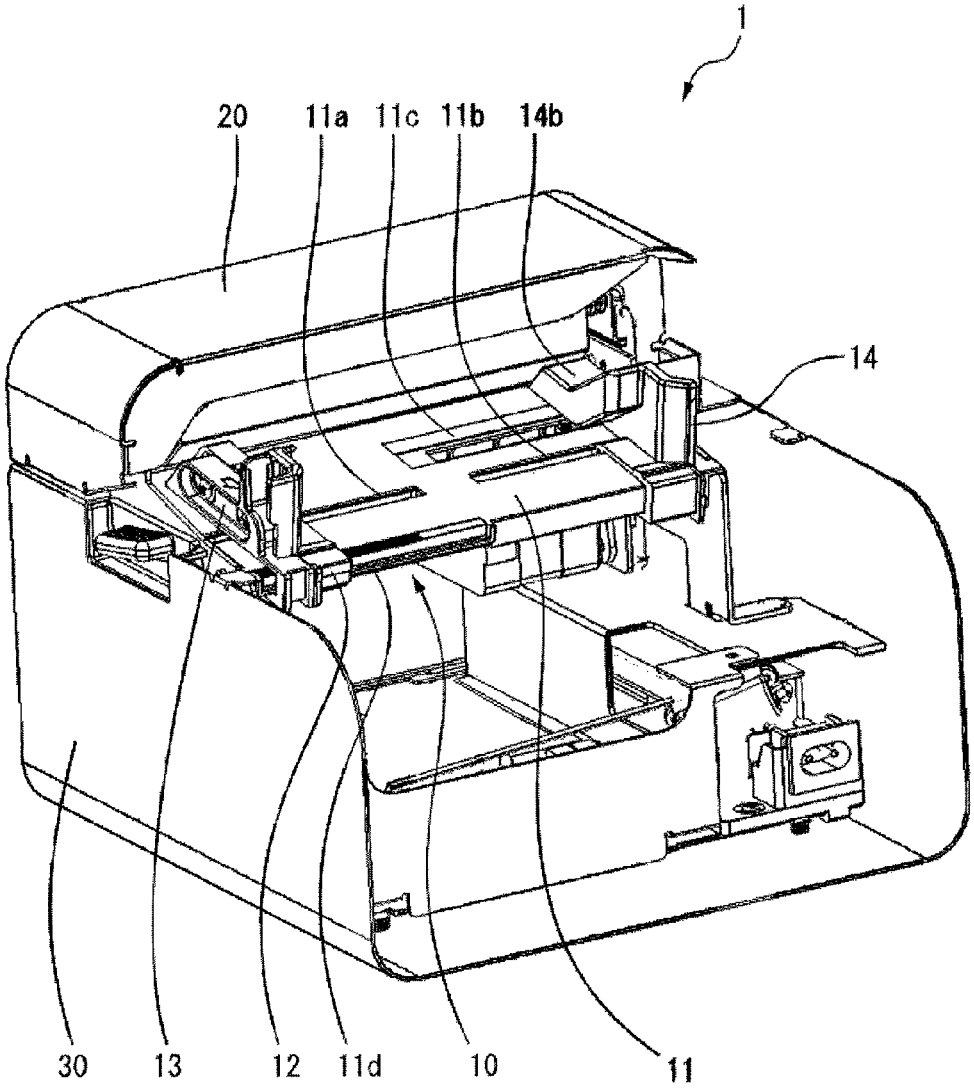
FIG. 1 is a schematic perspective view showing a printer 1 which includes a paper guide mechanism 10 according to a first embodiment of the present invention.
Figure 2:
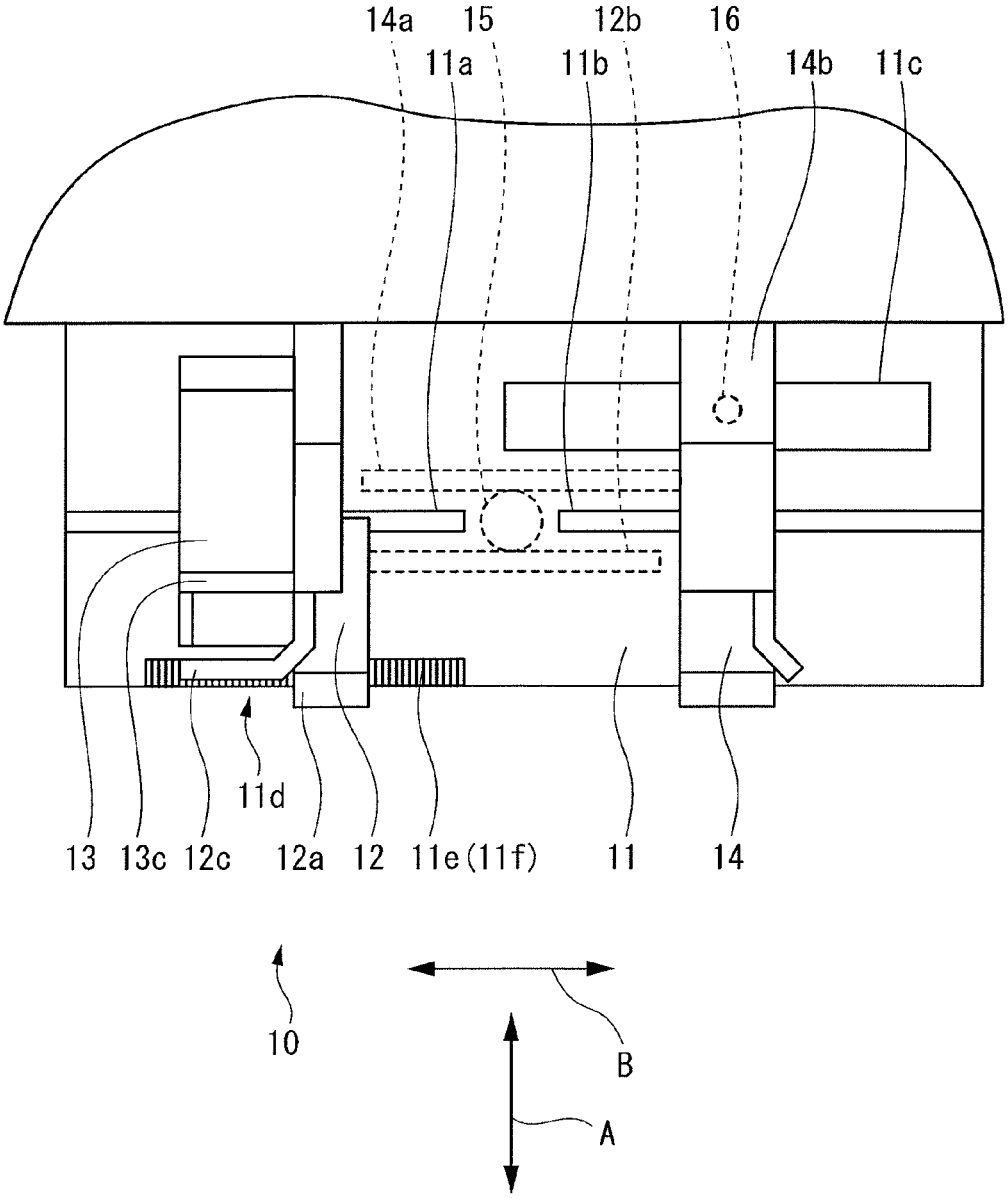
FIG. 2 is a schematic plan view of the paper guide mechanism 10 as viewed from the top.

FIG. 1 is a schematic perspective view showing a printer 1 which includes a paper guide mechanism 10 according to a first embodiment of the present invention. FIG. 1 shows the printer with a covering member (not shown) removed for the sake of better visibility for the paper guide mechanism 10. FIG. 2 is a schematic plan view of the paper guide mechanism 10 as viewed from the top. Hereinafter, feeding directions of paper are defined by the arrow A in FIG. 2, while width directions of the paper are defined by the arrow B which is perpendicular to the arrow A and parallel to the surface of the paper in the description of the paper guide mechanism. Note that the drawings including FIGS. 1 and 2 provided below as references shows schematic representations, and the sizes and the shapes of members are occasionally exaggerated for ease of understanding. Also, the following description will show particular values, shapes, materials and the like, however they may be modified as appropriate.

The printer 1 includes the paper guide mechanism 10, a printing portion 20, and a case 30. The printer prints characters on continuous tag paper as the paper. The continuous tag paper is formed of tags which are arranged side by side. Here, in the following description, producing printed data output by using the printer is referred to as "printing characters", which is typical usage by those skilled in the art. The statement "printing characters" means producing printed data output by using the printer, and not limited to print characters but includes producing printed output in graphics form (e.g., barcodes), image, and the like.

The paper guide mechanism 10 is a mechanism which guides the paper to be fed to the printing portion 20.

The printing portion 20 includes a thermal head and platen rollers, for example (although these are not shown). The printing portion prints characters as various kinds of data on the continuous tag paper which is guided by the paper guide mechanism 10.

The printer 1 is covered by the case 30 and the covering member (not shown). The paper guide mechanism 10 is arranged inside the case 30 and the covering member.

The paper guide mechanism 10 is now described in detail. The paper guide mechanism 10 includes a supporting member 11, a width movement member 12, a position-holding member 13, a follower guide 14, and a pinion 15.

The supporting member 11 is a member having a substantially plate shape extending along the surface of the paper (continuous tag paper) in feeding. The supporting member 11 is a member that guides the paper along its surface direction in feeding. However, the continuous tag paper may not contact the supporting member 11 depending on a kind of paper. The reason for this is that the position of the continuous tag paper in the direction perpendicular to the paper plane can be also guided by the width movement member 12 and the follower guide 14, which will be discussed later, in this embodiment. Also, the supporting member 11 has slits 11*a* and 11*b*, an opening for sensing 11*c*, and an end surface guide portion 11*d*.

In addition, the supporting member 11 includes first and second fixing engagement portions 11*e* and 11*f* as engagement portions. The first fixing engagement portion 11*e* is formed in proximity to the end of the supporting member 11 on the front side. Here, the front side refers to the surface that faces the surface of the paper in feeding (first surface). The surface that is opposite to the first surface is referred to as the back side (second surface). The first fixing engagement portion 11*e* has protrusions as stationary identically-shaped elements that are aligned in the width directions. Thus, the protrusions and dents are formed in the first fixing engagement portion. Each of the stationary identically-shaped elements according to this embodiment has a substantially right-angled triangular shape in cross section.

The second fixing engagement portion 11*f* is formed in proximity to the end of the supporting member 11 on the back side. The second fixing engagement portion is arranged on a part of the supporting member that faces the first fixing engagement portion 11*e*, which is arranged on the front side. The second fixing engagement portion 11*f* has protrusions as stationary identically-shaped elements that are aligned in the width directions of the paper similar to the first fixing engagement portion 11*e*. Thus, protrusions and dents are formed in the second fixing engagement portion. Each of the stationary identically-shaped elements according to this embodiment has a substantially right-angled triangular shape in cross section. Note that the ends of the stationary identically-shaped elements and movable identically-shaped elements, which will be discussed later with reference to FIG. 6, have a very small radius (R). From this viewpoint, in the strict sense, the shape of each of the identically-shaped elements is not a perfect triangle.

The width movement member 12 is movably attached in the width directions to the supporting member 11. The width movement member guides one width-directional side edge of the paper. The width movement member 12 is movably guided in the width directions along the slit 11*a*. In addition, the width movement member 12 includes an end surface engagement portion 12*a* that engages the end surface guide portion 11*d* (see FIGS. 4 and 5). To move the width movement member 12, when grip portions 12*c* and 13*c* (discussed later) are squeezed by operators' thumb and finger, the end surface engagement portion 12*a* is pushed toward and contacts the end surface guide portion 11*d* so that the end surface engagement portion guides the width movement member 12 in the width directions for smooth movement of the width movement member. In addition, the width movement member 12 includes a rack 12*b* on the back side of the supporting member 11. The rack 12*b* meshes with the pinion 15. Thus, a rack and pinion mechanism is constructed of the rack 12*b* and the pinion 15. In addition, the width movement member 12 includes the grip portion 12*c*, which extends substantially perpendicular to the feeding directions so that operators can squeeze the grip portions 12*c* and 13*c* (the grip portion 13*c* will be discussed later) with operators' thumb and finger.

The position-holding member 13 is a member which is attached to the width movement member 12, and locks the position of the width movement member 12 in the width directions. The position-holding member 13 will be described later in detail. A width guide is constructed of the width movement member 12 and the position-holding member 13, and guides the position of the paper in the width directions which intersect the feeding directions of the paper. More specifically, the width guide, which is constructed of the width movement member 12 and the position-holding member 13, guides one width-directional end of the paper.

The follower guide 14 restricts the position of the paper on the side opposite to the width movement member 12 in the width directions, and guides the paper. The follower guide 14 is movably guided in the width directions along the slit 11*b*. In addition, the follower guide 14 includes a rack 14*a* on the back side of the supporting member 11. The rack 14*a* meshes with the pinion 15 on the side opposite to the rack 12*b*. Thus, the rack and pinion mechanism is additionally constructed of the rack 14*a* and the pinion 15. According to this construction, when the width movement member 12 is moved in the width directions, the follower member 14 is moved in response to the movement of width movement member 12 in a direction corresponding to the moving direction of the width movement member 12. That is, when the width movement member 12 is moved in a direction along which the paper width is increased, the follower guide 14 is correspondingly moved in a direction along which the paper width is increased. On the other hand, when the width movement member 12 is moved in another direction, in other words, when the width movement member is moved in a direction along which the paper width is reduced, the follower guide 14 is correspondingly moved in a direction along which the paper width is reduced.

In addition, the follower guide 14 includes an upper guide portion 14*b*, and a back side sensor-mounting portion (not shown). The upper guide portion is cantilevered above the paper to be guided. The back side sensor-mounting portion faces the upper guide portion 14*b* so that the supporting member 11 is interposed between them. A sensor 16 is mounted to the upper guide portion 14*b* and the back side sensor-mounting portion. The sensor 16 is a transmissive optical sensor constructed of light-emitting and light-receiving parts, for example. The light-emitting and light-receiving parts face each other so that the opening for sensing 11*c* is arranged between them. The sensor 16 is used to detect the position of the paper. Note that a reflective optical sensor may be used as the sensor 16.

The pinion 15 is rotatably attached onto the back side of the supporting member 11, and meshes with the racks 12*b* and 14*a* as discussed above.

Figure 3:
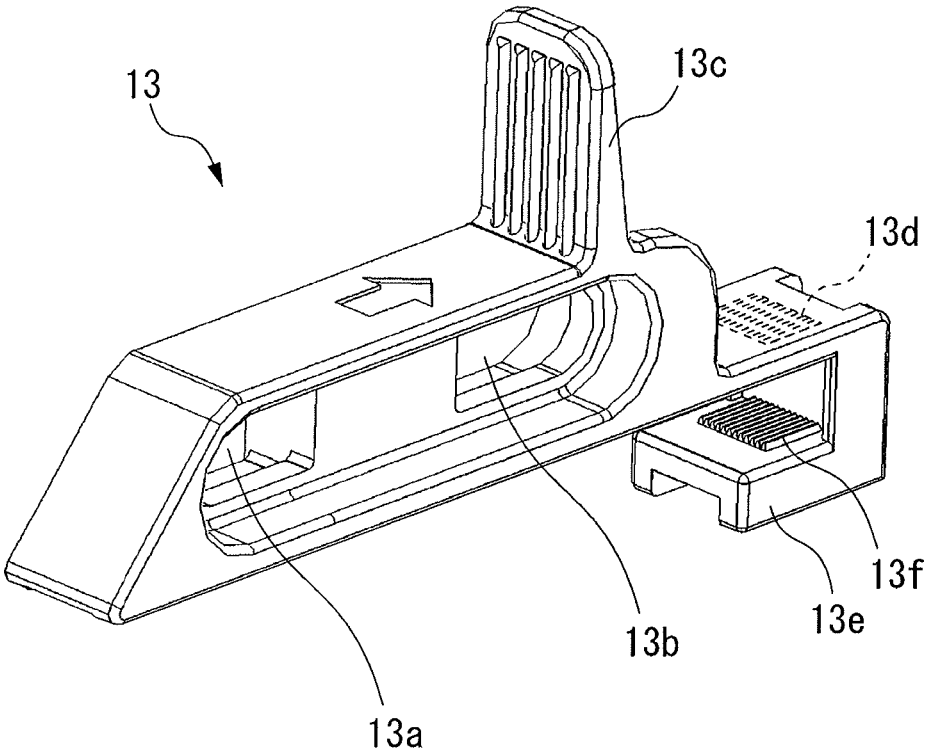
FIG. 3 is a schematic perspective view of a position-holding member 13.
Figure 4A:
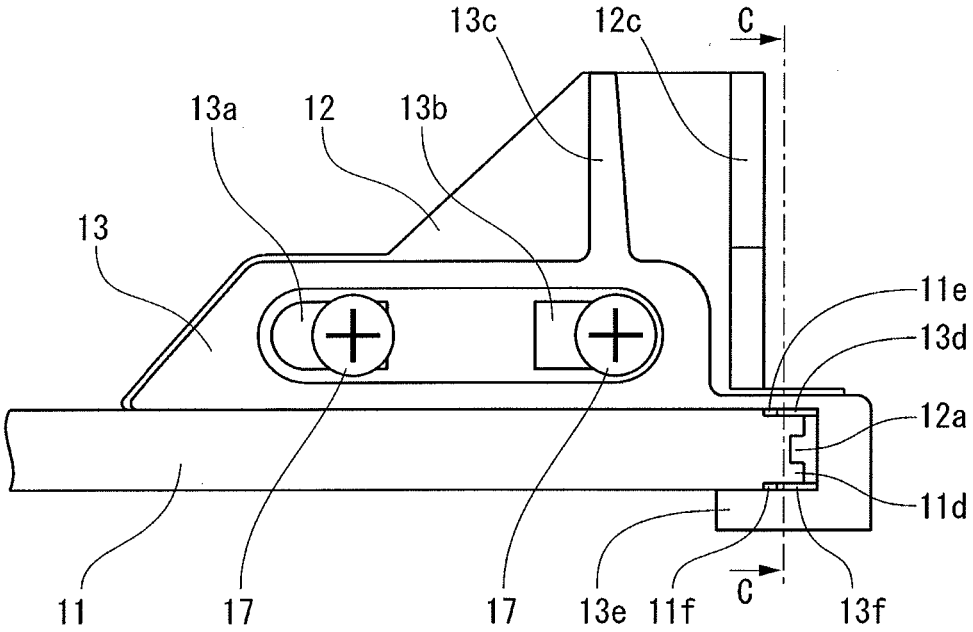
FIG. 4 is a schematic side view showing relationships between a supporting member 11, a width movement member 12, and the position-holding member 13.
Figure 4B:
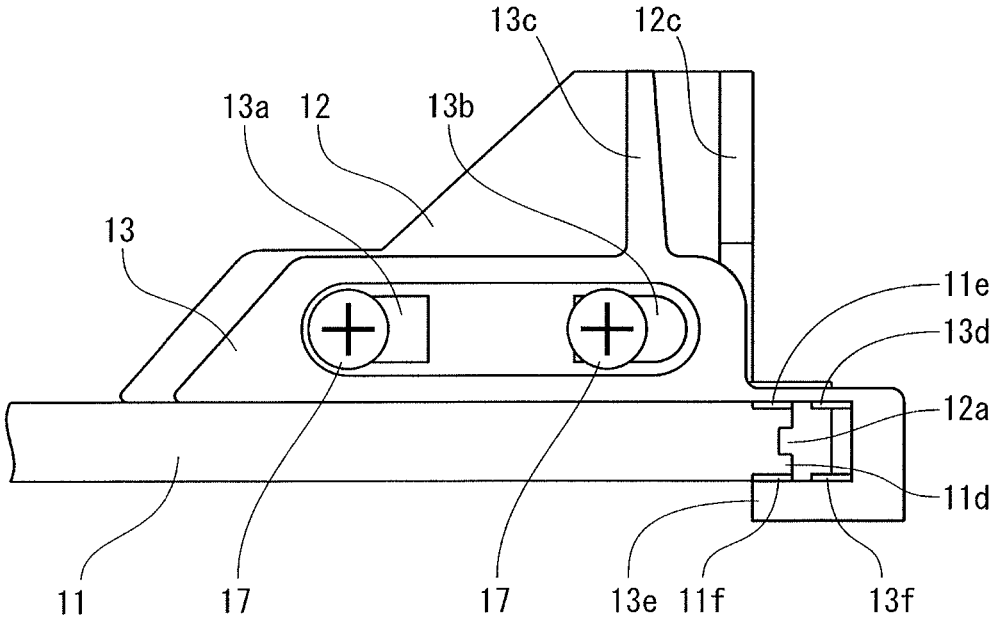
Figure 5A:
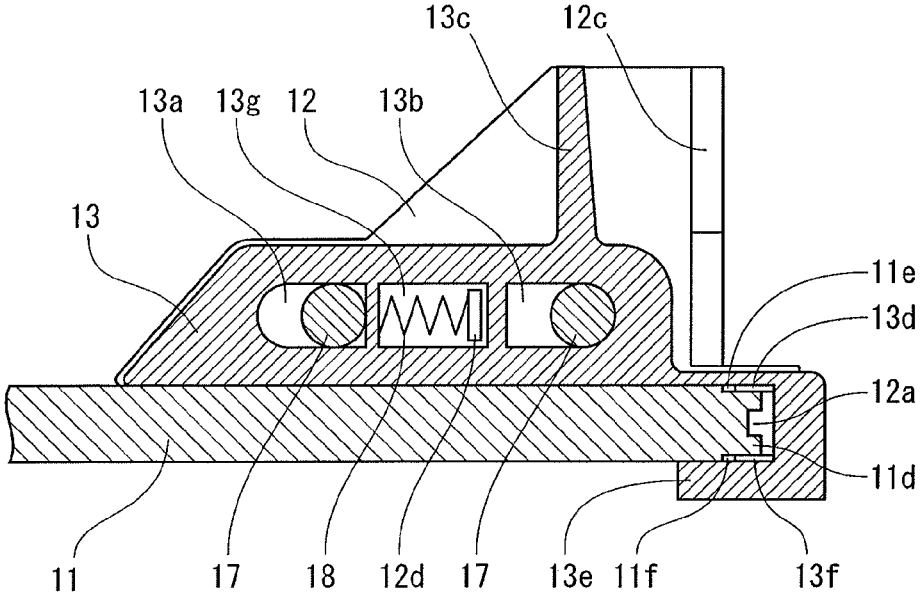
FIG. 5 is a schematic cross-sectional side view showing the relationships between the supporting member 11, the width movement member 12, and the position-holding member 13.
Figure 5B:
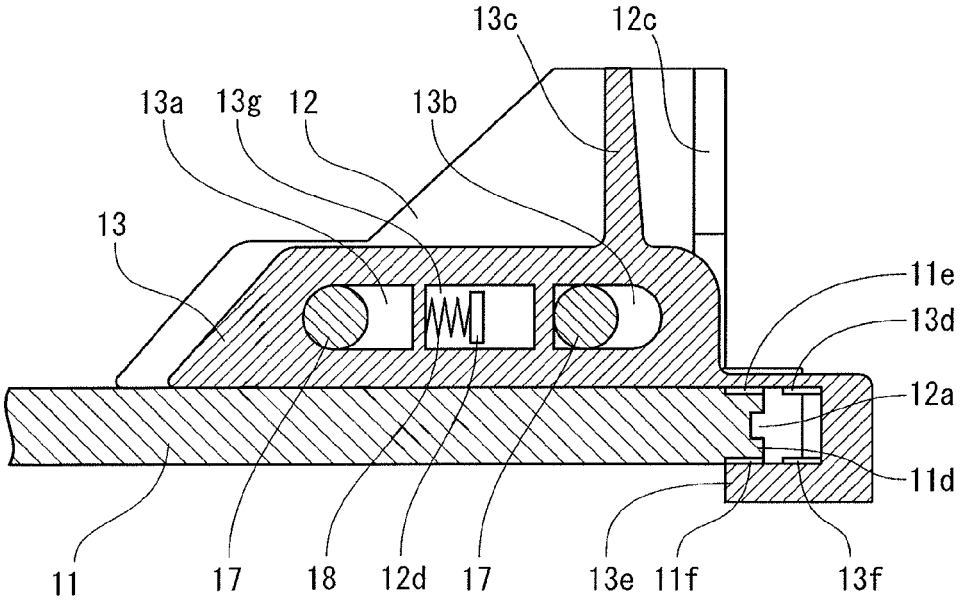

FIG. 3 is a schematic perspective view of the position-holding member 13. Schematic side views in FIG. 4 show relationships between the supporting member 11, the width movement member 12, and the position-holding member 13. Schematic cross-sectional side views in FIG. 5 show the relationships between the supporting member 11, the width movement member 12, and the position-holding member 13. The position-holding member 13 is movably arranged in the direction along the feeding directions between a locked position shown in FIGS. 4A and 5A, and an unlocked position shown in FIGS. 4B and 5B. At the locked position, the position-holding member 13 locks the position of the width movement member 12 in the width directions. As a result, the width movement member 12 cannot be moved in the width directions, when the position-holding member 13 is located at the locked position. On the other hand, at the unlocked position, the position-holding member 13 unlocks the position of the width movement member 12 in the width directions. As a result, the width movement member 12 can be moved in the width directions, when the position-holding member 13 is located at the unlocked position. The structure will be described in detail below which locks and unlocks the position of the width movement member 12 in the width directions at the locked and the unlocked positions, respectively.

The position-holding member 13 has elongated holes 13*a* and 13*b*, the grip portion 13*c*, a first movement engagement portion 13*d*, a movement restrictor 13*e*, a second movement engagement portion 13*f*, and a spring housing 13*g*.

The elongated holes 13*a* and 13*b* extend along the feeding directions of the paper, and penetrate the position-holding member in the width directions. The width movement member 12 corresponding to the elongated holes has screw holes (not shown) into which screws 17 as fastening members are screwed. The position-holding member 13 is movably attached in the feeding directions to the width movement member 12 by screwing the screws 17 into the screw holes of the width movement member 12 after passing the screws 17 through the elongated holes 13*a* and 13*b*. The position-holding member 13 can be easily replaced by unscrewing the screws 17. Since the position-holding member 13 can be easily replaced, the paper guide mechanism can be easily changed to a width-fixed paper guide mechanism, which does not change the width of paper to be guided, by replacing the position-holding member which has the elongated holes 13*a* and 13*b* by a position-holding member which has circular holes through which the screws 17 pass, for example.

The grip portion 13*c* extends perpendicular to the feeding directions so that operators can squeeze the grip portions 12*c* and 13*c*.

The first movement engagement portion 13*d* has protrusions as movable identically-shaped elements that are aligned in the width directions in a part of the supporting member 11 that faces the first fixing engagement portion 11*e*. The protrusions are formed complementary to the stationary identically-shaped elements of the first fixing engagement portion 11*e*. Thus, protrusions and dents are formed in the first movement engagement portion. Each of the movable identically-shaped elements according to this embodiment has a substantially right-angled triangular shape in cross section similar to the stationary identically-shaped elements.

The movement restrictor 13*e* surrounds the end of the supporting member 11, and reaches the back side of the supporting member 11 so that the movement restrictor contacts the back side of the supporting member 11. The movement restrictor 13*e* restricts the movement of the position-holding member 13 in a direction along which the first movement engagement portion 13*d* is moved away from the first fixing engagement portion 11*e* (upward movement). Note that, although the movement restrictor 13*e* restricts the movements of both the first fixing engagement portion 11*e* and the first movement engagement portion 13*d* in this embodiment, the present invention is not limited to this. For example, the movement restrictor may restrict the movement of only the first fixing engagement portion 11*e* or the first movement engagement portion.

The second movement engagement portion 13*f* is formed on the movement restrictor 13*e*, and is arranged in a part of the movement restrictor that faces the second fixing engagement portion 11*f*. The second movement engagement portion 13*f* has movable identically-shaped elements of protrusions and dents that are complementary to the stationary identically-shaped elements of the second fixing engagement portion 11*f* and are aligned in the width directions. Each of the movable identically-shaped elements according to this embodiment has a substantially right-angled triangular shape in cross section similar to the stationary identically-shaped elements.

The spring housing 13*g* is a room for accommodating a coil spring 18. The coil spring 18 is a compressed spring as a biasing member which is accommodated in the spring housing 13*g*. In the spring housing 13*g*, the coil spring 18 is compressed between a spring-receiving portion 12*d* of the width movement member 12 and the surface of a wall of the spring housing 13*g*. Thus, the coil spring 18 applies force toward the locked position to the position-holding member 13. In order to make the width movement member 12 movable, operators squeezes the grip portions 12*c* and 13*c* with their thumb and finger so that the position-holding member 13 is moved against the applied force of the coil spring 18 from the locked position (FIGS. 4A and 5A) to the unlocked position (FIGS. 4B and 5B).

Figure 6:
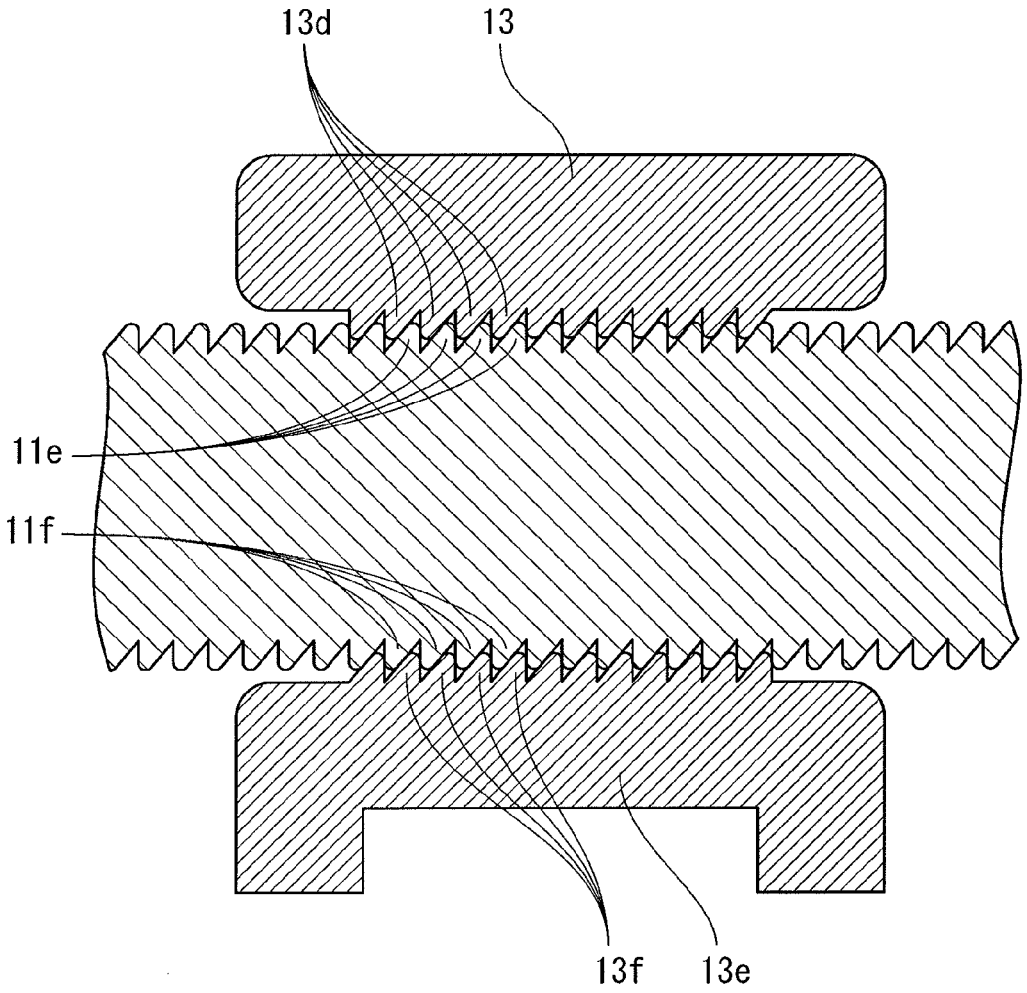
FIG. 6 is a schematic cross-sectional view corresponding to FIG. 4 taken along the line C-C as viewed in the direction of the arrows.

FIG. 6 is a schematic cross-sectional view corresponding to FIG. 4 taken along the line C-C as viewed in the direction of the arrows. The stationary identically-shaped elements each having a substantially right-angled triangular shape are formed on each of the first and second fixing engagement portions 11*e* and 11*f*, and are aligned in the width directions. The stationary identically-shaped elements of the first and second fixing engagement portions 11*e* and 11*f* have surfaces perpendicular to the width directions (the moving directions of the width movement member 12). Note that the surfaces perpendicular to the width directions of the stationary identically-shaped elements of the first fixing engagement portion 11*e* face a direction opposite to the surfaces perpendicular to the width directions of the stationary identically-shaped elements of the second fixing engagement portion 11*f*. That is, the surfaces perpendicular to the width directions of the stationary identically-shaped elements of the first fixing engagement portion 11*e* face rightward in FIG. 6, while the surfaces perpendicular to the width directions of the stationary identically-shaped elements of the second fixing engagement portion 11*f* face leftward in FIG. 6. Here, in description of this specification and claims, "perpendicular to the width directions (the moving directions of the width movement member)" refers to perpendicular to an imaginary line that extends in the width directions.

Also, the movable identically-shaped elements each having a substantially right-angled triangular shape are formed on each of the first and second movement engagement portions 13*d* and 13*f*, and are aligned in the width directions. The surfaces perpendicular to the width directions of the movable identically-shaped elements of the first movement engagement portion 13*d* face the surfaces perpendicular to the width directions of the stationary identically-shaped elements of the first fixing engagement portion 11*e* so that they contact. Similar to this, the surfaces perpendicular to the width directions of the movable identically-shaped elements of the second movement engagement portion 13*f* face the surfaces perpendicular to the width directions of the stationary identically-shaped elements of the second fixing engagement portion 11*f* so that they contact.

Since the stationary and movable identically-shaped elements are arranged as discussed above, when the width movement member 12 and the position-holding member 13 are moved toward a direction of the width directions, the surfaces perpendicular to the width directions of the stationary and movable identically-shaped elements contact each other in the first stationary and movement engagement portions, or the second stationary and movement engagement portions. As a result, it is possible to restrict the movement of the width movement member 12 and the position-holding member 13 in the width directions.

More specifically, even in the case where a force is applied to move the width movement member 12 and the position-holding member 13 leftward in FIG. 6, the surfaces perpendicular to the width directions of the stationary identically-shaped elements of the first fixing engagement portion 11*e* contact the surfaces perpendicular to the width directions of the movable identically-shaped elements of the first movement engagement portion 13*d*, and provides a counteraction force that counteracts the applied force. Accordingly, no component of force is applied to move the first movement engagement portion 13*d* away from the first fixing engagement portion 11*e*. On the other hand, in this case, the oblique sides of the movable identically-shaped elements of the second movement engagement portion 13*f* contact the oblique sides of the stationary identically-shaped elements of the second fixing engagement portion 11*f*, and thus, force acts on the oblique sides of movable identically-shaped elements. Accordingly, a component of force that moves the second movement engagement portion 13*f* away from the second fixing engagement portion 11*f* acts on the contact parts. However, this component of the force will push the first stationary and movement engagement portions 11*e* and 13*d* toward each other, which in turn will increase the force of the first movement engagement portion that counteracts the force for moving the width movement member 12 and the position-holding member 13 leftward.

Even in another case where a force is applied to move the width movement member 12 and the position-holding member 13 rightward in FIG. 6, the surfaces perpendicular to the width directions of the stationary identically-shaped elements of the second fixing engagement portion 11*f* contact the surfaces perpendicular to the width directions of the movable identically-shaped elements of the second movement engagement portion 13*f*, and provides a counteraction force that counteracts the applied force. Accordingly, no components of force are provided to move the second movement engagement portion 13*f* away from the first fixing engagement portion 11*f*. On the other hand, in this case, the oblique sides of the movable identically-shaped elements of the first movement engagement portion 13*d* contact the oblique sides of the stationary identically-shaped elements of the first fixing engagement portion 11*e*, and thus, force acts on the oblique sides of movable identically-shaped elements. Accordingly, a component of force that moves the first movement engagement portion 13*d* away from the first fixing engagement portion 11*e* acts on the contact parts. However, this component of the force will push the second stationary and movement engagement portions 11*f* and 13*f* toward each other, which in turn will increase the force of the second movement engagement portion that counteracts the force for moving the width movement member 12 and the position-holding member 13 rightward.

The working of the paper guide mechanism 10 is now described in the operating procedure for changing the width of paper to be guided. To change the width of paper to be guided, operators squeeze the grip portions 12*c* and 13*c* with their thumb and finger so that the position-holding member 13 is moved from the locked position to the unlocked position. This movement disengages the first stationary and movement engagement portions 11*e* and 13*d* from each other, and also disengages the second stationary and movement engagement portions 11*f* and 13*f* from each other. If the operators keep squeezing the grip portions and move the width movement member 12 and the position-holding member 13 in the width directions, then the follower guide 14 is simultaneously moved with the width movement member 12 and the position-holding member 13 by the working of the rack and pinion mechanism. When the width movement member 12, the position-holding member 13, and the follower guide 14 are moved to their positions corresponding to the width to be matched, operators release the grip portions 12*c* and 13*c*. Then, the applied force of the coil spring 18 is exerted by the release so that the position-holding member 13 is moved from the unlocked position to the locked position. As a result, the first fixing engagement portion 11*e* interlocks with the first movement engagement portion 13*d*, and the second fixing engagement portion 11*f* interlocks with the second movement engagement portion 13*f*.

(Arrangement of Interlocking Portion)

In the foregoing first embodiment, the first and second fixing engagement portions 11*e* and 11*f* have been illustratively described which are arranged in proximity to the end of the supporting member 11. However, the location of the engagement portion is not limited to this. The engagement portion can be arranged in different positions. The following description will describe modified embodiments in which the engagement portion is arranged in other locations.

(Position of Interlocking Portion in First Modified Embodiment)

For example, the engagement portion can be arranged in the middle or downstream-side part of the supporting member 11. According to this modified embodiment, the present invention can be applied in the case where the width movement member cannot be arranged in proximity to the upstream-side end part of the supporting member.

(Position of Interlocking Portion in Second Modified Embodiment)

Figure 7A:
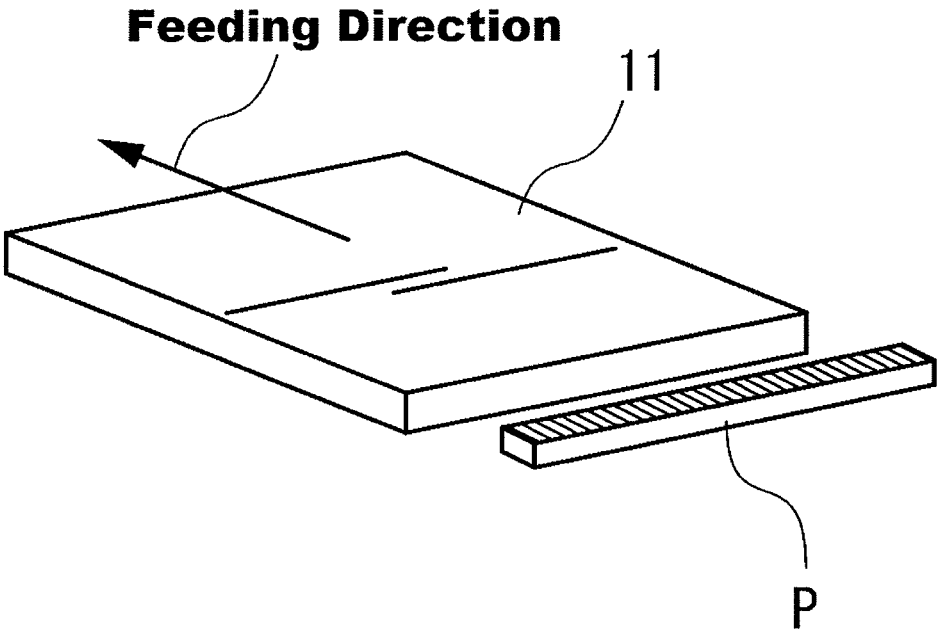
FIG. 7 is a schematic view showing the arrangement of engagement portions according to a second modified embodiment.
Figure 7B:
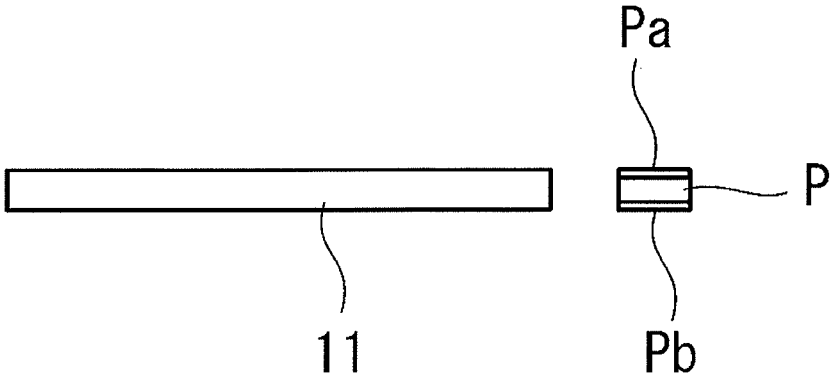

Schematic views in FIG. 7 show the arrangement of engagement portions according to a second modified embodiment. FIG. 7A is the schematic perspective view. FIG. 7B is the schematic side view. Here, although the movement engagement portions are not shown in FIG. 7, the movement engagement portions are arranged in a location that faces the fixing engagement portions. The fixing engagement portions (first and second fixing engagement portions Pa and Pb) according to the modified embodiment shown in FIG. 7 are arranged on a member P separated from the supporting member 11. In the modified embodiment shown in FIG. 7, the member P is arranged in proximity to the upstream-side part of the supporting member 11. In this arrangement, since the engagement portions can be arranged in the location in proximity to the width guide, it is possible to avoid increasing the paper guide mechanism in size. Note that, since the engagement portions are arranged on the member separated from the supporting member 11 in the modified embodiment shown in FIG. 7, the engagement portions can be arranged in the suitable location depending on the device which includes the engagement portions without concern about the position, the shape and the like of the supporting member 11.

(Position of Interlocking Portion in Third Modified Embodiment)

Figure 8:
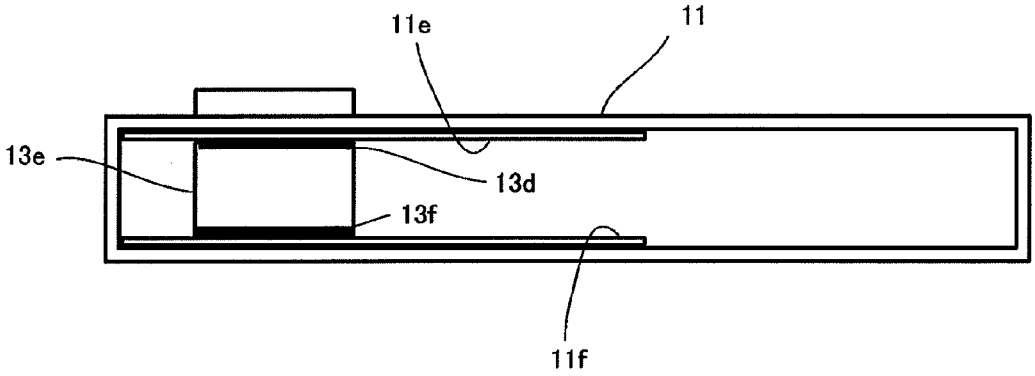
FIG. 8 is a schematic view showing the arrangement of engagement portions according to a third modified embodiment.

FIG. 8 is a schematic cross-sectional view showing the arrangement of engagement portions according to a third modified embodiment. The supporting member 11 according to the modified embodiment shown in FIG. 8 has a hollow elongated box shape. The first and second fixing engagement portions 11*e* and 11*f* are arranged on the upper and lower interior surfaces. The movement restrictor 13*e* is inserted into the hollow part of the supporting member 11. The first and second movement engagement portions 13*d* and 13*f* are formed on the upper and lower surfaces of the movement restrictor, respectively. Thus, the first and second movement engagement portions 13*d* and 13*f* interlock with the first and second fixing engagement portions 11*e* and 11*f*, respectively. According to the arrangements of the engagement portions, the supporting member 11 restricts more surely the upward and downward movement by the movement restrictor 13*e*. Since the possibility of unintentional disengagement of the engagement portions from each other can be low, the engagement portions can have smaller protrusions and dents.

As discussed above, according to the first embodiment, the position-holding member 13 is movably arranged in the feeding directions, while the first and second fixing engagement portions 11*e* and 11*f* can interlock with the first and second movement engagement portions 13*d* and 13*f*, respectively. Accordingly, it becomes possible to easily switch the position-holding member between the locked position, which locks the movement of the width movement member 12, and the unlocked position. Therefore, the paper guide mechanism provides good operability. In particular, the applied force of the coil spring 18 does not have an effect on the restriction force for restricting the movement of the width movement member 12, and vice versa. For this reason, the applied force of the coil spring 18 can be low. Additionally, from this viewpoint, the paper guide mechanism provides good operability. In addition, the movement restrictor 13*e* is provided which restricts the movement of the position-holding member 13 in a direction along which the first movement engagement portion 13*d* is moved away from the first fixing engagement portion 11*e*. Accordingly, even if a large force is applied to the width movement member 12, it is possible to prevent the movement in the width directions of the width movement member 12 whereby locking the position of the width movement member 12. Also, the stationary identically-shaped elements of the first and second fixing engagement portions 11*e* and 11*f* have surfaces perpendicular to the width directions. The surfaces perpendicular to the width directions of the stationary identically-shaped elements of the first fixing engagement portion 11*e* face a direction opposite to the surfaces perpendicular to the width directions of the stationary identically-shaped elements of the second fixing engagement portion 11*f*. In addition to this, the surfaces perpendicular to the width directions of the movable identically-shaped elements of the first and second movement engagement portions 13*d* and 13*f* face the surfaces perpendicular to the width directions of the stationary identically-shaped elements of the first and second fixing engagement portions 11*e* and 11*f* so that they contact. Accordingly, when a force is applied to move the width movement member 12 toward a direction of the width directions, the surfaces perpendicular to the width directions can provide a counteraction force that counteracts the applied force so that disengagement of the engagement portions from each other can be prevented. Also, according to this construction, even in the case where the identically-shaped elements of the engagement portions are small, it is possible to prevent the movement of the width movement member 12. For this reason, the width of paper to be guided can be adjusted in fine increments by reducing the size of the identically-shaped elements of the engagement portions.

Second Embodiment

Figure 9:
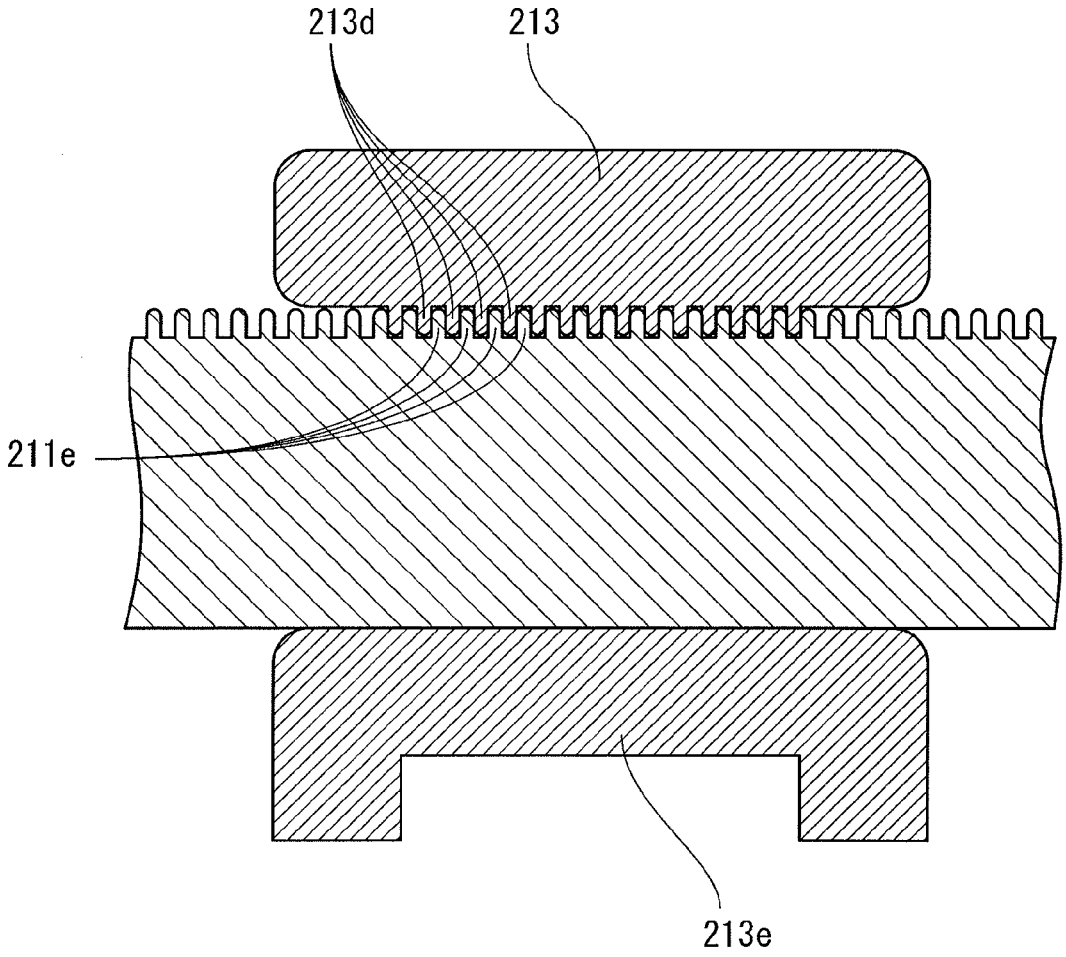
FIG. 9 is a schematic cross-sectional view of first stationary and movement engagement portions 11*e* and 13*d* according to a second embodiment shown similarly to the cross-sectional view of the first embodiment shown in FIG. 6.

FIG. 9 is a schematic cross-sectional view of first stationary and movement engagement portions 211*e* and 213*d* according to a second embodiment shown similarly to the cross-sectional view of the first embodiment shown in FIG. 6. The second embodiment has only two differences from the first embodiment. As shown in FIG. 9, the first difference is that the first stationary and movement engagement portions 211*e* and 213*d* according to the second embodiment have shapes different from the first embodiment, and the second difference is that the shapes corresponding to the second stationary and movement engagement portions 11*f* and 13*f*, which is discussed in the first embodiment, are not formed. Elements having the same functions as the components described in the foregoing first embodiment are attached with the same reference signs, and their description is omitted for the sake of brevity.

The first fixing engagement portion 211*e* is formed in proximity to the end of the supporting member 211 on the front side. The first fixing engagement portion 211*e* has protrusions as stationary identically-shaped elements that are aligned in the width directions. Thus, the protrusions and dents are formed in the first fixing engagement portion. Dissimilar to the first embodiment, the stationary identically-shaped elements according to the second embodiment have a substantially rectangular shape in cross section. Note that each of the ends of the stationary identically-shaped elements and each of the movable identically-shaped elements shown in FIG. 9 has a very small radius (R). From this viewpoint, in the strict sense, the shape of the identically-shaped elements is not a perfect rectangle.

The first movement engagement portion 213*d* has protrusions as movable identically-shaped elements that are aligned in the width directions in a part of the supporting member 211 that faces the first fixing engagement portion 211*e*. The protrusions are formed complementary to the stationary identically-shaped elements of the first fixing engagement portion 211*e*. Thus, protrusions and dents are formed in the first movement engagement portion. The movable identically-shaped elements according to this embodiment have a substantially rectangular shape in cross section similar to the stationary identically-shaped elements.

Also, the position-holding member 213 according to the second embodiment includes the movement restrictor 213*e* similar to the first embodiment. However, the movement restrictor 213*e* according to the second embodiment does not have the shape corresponding to the second movement engagement portion 13*f*, which is discussed in the first embodiment. Correspondingly, the back side of the supporting member 211 according to the second embodiment does not have the shape corresponding to the second fixing engagement portion 11*f*, which is discussed in the first embodiment.

As discussed above, the paper guide mechanism according to the second embodiment does not have the shapes corresponding to the second stationary and movement engagement portions 11*f* and 13*f*, which is discussed in the first embodiment. However, in the paper guide mechanism according to the second embodiment, the stationary and movable identically-shaped elements of the first stationary and movement engagement portions 211*e* and 213*d* have rectangular shapes in cross section. For this reason, when a force is applied to move the width movement member 12 toward a direction of the width directions, a counteraction force that counteracts the applied force acts only in the width directions to the surfaces perpendicular to the width directions. As a result, no components of the counteraction force are provided which moves the first movement engagement portion 213*d* away from the first fixing engagement portions 211*e*. In addition, the movement restrictor 213*e* prevents the movement of the position-holding member 213 in a direction along which the first movement engagement portion 213*d* is moved away from the first fixing engagement portion 211*e*.

As discussed above, although the paper guide mechanism according to the second embodiment has a simpler structure than the first embodiment, its guide portion can be less likely to be unintentionally moved, and provides good operability.

Modified Embodiment

The present invention is not limited to the foregoing embodiments. Various changes and modifications can be made without departing from the spirit of the present invention, and such changes and modifications fall within the scope of the present invention.

In the first embodiment, the stationary and movable identically-shaped elements have been illustratively described each having a substantially right-angled triangular shape in cross section. However, the identically-shaped elements are not limited to this. The identically-shaped elements are only required to have the vertical surface. For example, they may have a curved surface or the like in the part corresponding to their oblique side.

In the foregoing embodiments, the paper guide mechanism has been illustratively described which guides paper to be fed to the printing portion of the printer. However, the present invention is not limited to this. For example, the present invention can be applied to a paper guide mechanism which guides paper in a shearing machine for cutting paper, or a feeder for feeding paper. Also, paper has been illustratively described as a medium for printing. However, the present invention is not limited to this. Any type of media that can be used includes, but not limited to, any kinds of films, belt-shaped sheets, rectangular sheets, and whatever printable.

Note that although not described, the foregoing embodiments and modified embodiments can be suitably combined. The present invention is not limited to the foregoing embodiments.

REFERENCE SIGNS LIST

1 Printer
10 Paper Guide Mechanism
11, 211 Supporting Member
11*a*, 11*b* Slit
11*c* Opening for Sensing
11*d* End Surface Guide Portion
11*e*, 211*e* First Stationary Interlocking Portion
11*f* Second Stationary Interlocking Portion
12 Width-Directionally Moving Member
12*a* End Surface Engagement Portion
12*b* Rack
12*c* Grip Portion
12*d* Spring-Receiving Portion
13, 213 Position Holding Member
13*a*, 13*b* Elongated Hole
13*c* Grip Portion
13*d*, 213*d* First Movement Engagement Portion
13*e*, 213*e* Movement Engagement Portion
13*f* Second Movement Engagement Portion
13*g* Spring Housing
14 Follower Guide
14*a* Rack
14*b* Upper Guide
15 Pinion
16 Sensor
17 Screw
18 Coil Spring
20 Printing Portion
30 Case

The invention claimed is:

1. A paper guide mechanism for guiding paper to be fed, the paper guide mechanism comprising:

a plate-shaped supporting member having a first surface for facing the paper to be fed on a top side of the supporting member, and a second surface on an opposite bottom side of the supporting member;

a width-directionally moving member configured to be attached to the supporting member so as to be movable in a width direction which is orthogonal to a feeding direction of the paper; and a position-holding member configured to be attached to the width-directionally moving member and to be movable between a first position and a second position, the first position being a position at which the position-holding member engages the supporting member on at least of one of the first surface and the second surface of the supporting member and thereby locks a position of the width-directionally moving member in the width direction, the second position being a position at which the position-holding member disengages from the supporting member and thereby unlocks a position of the width-directionally moving member in the width direction, wherein the position-holding member is formed so as to face both the first surface on the top side of the supporting member and the second surface on the bottom side of the supporting member, and thereby sandwich the supporting member at the edge portion of the supporting member, and the position-holding member is configured to slide on both the first surface and the second surface of the supporting member to move between the first position and the second position.

2. The paper guide mechanism according to claim 1, wherein the supporting member includes a fixing engagement portion including first identically-shaped elements aligned in the width direction, the position holding member includes a movement engagement portion including second identically-shaped elements aligned in the width direction, and when the position holding member is at the first position, the fixing engagement portion and the movement engagement portion are engaged.

3. The paper guide mechanism according to claim 2, wherein the fixing engagement portion includes: a first fixing engagement portion that is arranged on the first surface of the supporting member; and a second fixing engagement portion that is arranged on the second surface of the supporting member, the movement engagement portion includes: a first movement engagement portion that is arranged to be facing the first surface; and a second movement engagement portion that is arranged to be facing the second surface, and when the position-holding member is at the first position, the first fixing engagement portion and the first movement engagement portion are engaged, and the second fixing engagement portion and the second movement engagement portion are engaged.

4. The paper guide mechanism according to claim 1, further comprising a biasing member that applies force toward the first position to the position-holding member.

5. The paper guide mechanism according to claim 1, wherein the position-holding member is detachably attached to the width-directionally moving member using a fastening member.

* * * * *